US005593629A

United States Patent [19]

Travelute et al.

[11] Patent Number: 5,593,629

[45] Date of Patent: Jan. 14, 1997

[54] METHOD FOR INCREASED PRODUCTIVITY OF INDUSTRIAL FIBER

[75] Inventors: Frederick L. Travelute, Charlotte, N.C.; Robert E. Hoffman, Catawba; Mendel L. Poston, Jr., Pamplico, both of S.C.

[73] Assignee: Wellman, Inc., Shrewsbury, N.J.

[21] Appl. No.: 392,033

[22] Filed: Feb. 22, 1995

[51] Int. Cl.[6] ..... D01D 5/24

[52] U.S. Cl. ..... 264/209.3; 264/209.4; 264/209.5; 264/211.14

[58] Field of Search ..... 264/209.1, 209.3, 264/209.4, 209.5, 210.8, 211.14

[56] References Cited

U.S. PATENT DOCUMENTS

| | | | |
|---|---|---|---|
| 3,322,611 | 5/1967 | Stevenson . | |
| 3,630,824 | 12/1971 | Röhlig | 264/209.5 X |
| 3,969,462 | 7/1976 | Stofan | 264/210.8 X |
| 4,098,864 | 7/1978 | Morris et al. | 264/289.3 |
| 4,251,481 | 2/1981 | Hamlyn | 264/210.3 |
| 4,316,716 | 2/1982 | Lin . | |
| 4,559,975 | 12/1985 | Stits | 139/420 R |
| 4,675,378 | 6/1987 | Gibbon et al. | 528/272 |
| 4,780,073 | 10/1988 | Katsumi et al. . | |
| 4,968,471 | 11/1990 | Ito et al. | 264/210.8 X |
| 5,019,316 | 5/1991 | Ueda et al. | 264/210.8 X |
| 5,045,260 | 9/1991 | Humbrecht et al. | 264/210.8 X |
| 5,049,339 | 9/1991 | Hrivnak et al. | 264/210.8 |
| 5,049,447 | 9/1991 | Shindo et al. | 428/373 |
| 5,092,381 | 3/1992 | Feijen et al. | 152/451 |
| 5,102,603 | 4/1992 | Oblath et al. | 264/210.8 |
| 5,266,255 | 11/1993 | Gibbon et al. | 264/210.8 X |
| 5,322,921 | 6/1994 | Humbrecht et al. | 528/308 |
| 5,356,582 | 10/1994 | Aneja et al. | 264/209.3 X |
| 5,439,626 | 8/1995 | Bennett et al. | 264/209.3 X |
| 5,487,859 | 1/1996 | Anaja et al. | 264/209.3 X |

FOREIGN PATENT DOCUMENTS 601372 6/1994 European Pat. Off. .

OTHER PUBLICATIONS

Search Report for PCT/US95/17046 dated May 23, 1996, W. Westermayer.

Abstract of Japan 58–18, 417 (published Feb. 3, 1983).

*Primary Examiner*—Leo B. Tentoni

*Attorney, Agent, or Firm*—Bell, Seltzer, Park & Gibson, P.A.

[57] ABSTRACT

A process for producing industrial denier filaments of a thermoplastic polymer at higher rates of production than those using liquid quenching media is disclosed. Liquid polymer is extruded in the form of hollow filaments at a throughput and rate of take up that produces individual filaments of greater than about 30 denier. A flow of gas is then directed at the liquid filaments at a flow rate and temperature that are sufficient to quench and solidify the individual filaments in the absence of any other quenching fluid. The filaments formed by the disclosed process have larger diameters than solid filaments of the same denier.

11 Claims, No Drawings

METHOD FOR INCREASED PRODUCTIVITY OF INDUSTRIAL FIBER

FIELD OF THE INVENTION

The invention relates to a method of producing industrial filaments from a thermoplastic polymer, and in particular relates to polyester filaments with a denier of thirty or higher.

BACKGROUND OF THE INVENTION

Thermoplastic polymer fibers, particularly nylon and polyester fibers, have been widely used for many decades due to their high strength and wear characteristics. Such fibers in high denier ranges, particularly those greater than about 30 denier, have been used in industrial applications such as the manufacture of dish scouring pads and buffer pads. Thermoplastic polymer filaments are commonly manufactured by extruding liquified polymer through the holes of a round, solid spinnerette, then cooling the liquified polymer in a flow of air or inert gas to form solidified filaments. The filaments can also be drawn to further orient the polymer and produce the desired final size of filament.

Because the production of larger diameter fibers requires the solidification of a greater amount of polymer, it has previously been difficult to cool large denier filaments in a rapid manner using such an air or gas flow. In particular, an air flow is often insufficient to cool such larger filaments quickly enough to avoid their sticking together before they solidify. Alternatively, applying a greater amount of air can damage the filaments because the air speed required is often stronger than the filaments can withstand.

As a result, large denier filaments are conventionally spun into a water quench bath in order to solidify the polymer filaments. Water quenching of the filaments tends to greatly limit the process speed, however, because high process speeds tend to generate turbulence in the quench bath which in turn damages the filaments.

Therefore, the need exists for a method of making higher denier thermoplastic polymer filaments at more rapid throughput speeds.

OBJECT AND SUMMARY OF THE INVENTION

Therefore it is an object of the present invention to provide a method for producing industrial denier filaments of a thermoplastic polymer at higher rates of production than previously achievable using liquid quench media and to make high denier (large diameter) filaments on an air quench machine.

The present invention meets this object by extruding a liquid polymer in the form of hollow filaments at a throughput and rate of take up that produces individual filaments of greater than about 130 denier (spun denier). A flow of gas is then directed at the liquid filaments, with the gas flow being at a flow rate and temperature sufficient to quench and solidify the polymer filaments.

The present invention now will be described more fully hereinafter and preferred embodiments of the invention are described. This invention may, however, be embodied in many different forms and should not be construed as limited to the embodiments set forth herein; rather, these embodiments are provided so that this disclosure will be thorough and complete, and will fully convey the scope of the invention to those skilled in the art.

DETAILED DESCRIPTION

The present invention is a process for producing industrial denier filaments of a thermoplastic polymer at higher rates of production while avoiding the use of liquid quenching media. In the process, a liquid polymer is extruded in the form of hollow filaments. The polymer can be any polymer which can be provided in liquid form, with the method being particularly useful in forming polyester and nylon filaments. In the context of this invention, the term polyester is defined as the polymer produced by the condensation reaction of a glycol and a diacid, such as ethylene glycol and terephthalic acid or its derivatives. An example of polyester which can be used in the present process is polyethylene terephthalate, also referred to as PET. Nylon is the generic name for the well-known family of polyamide polymers that are characterized by the presence of the amide group (—CONH).

The polymer may be liquified in any conventional manner such as by melting or dissolving the polymer in a solvent. Then, hollow filaments are formed from the liquified polymer. One method of forming the hollow filaments is by extruding the liquified polymer through a spinnerette having annular shaped openings. A particularly desirable configuration for the spinnerette openings is one having an annular shape with the center portion of the annular shape forming approximately 60%, and preferably 62.5%, of the total cross-section of the opening. The sizes of the openings are such that they form filaments which, when solidified and taken up, will have a size of approximately 130 spun denier or greater.

As used herein, the phrase "spun denier" refers to the denier of the filaments after they exit the spinnerette and are initially taken up. As is well known to those of ordinary skill in this art, spun filaments are typically drawn to smaller sizes, and these are referred to herein as the "final" or "finished" denier.

After the liquid polymer is extruded into hollow filament form, the filaments are solidified by directing a flow of gas at the filaments at a flow rate and temperature sufficient to quench and solidify the filaments in the absence of any other quenching fluid. In a particularly preferred form, the gas which is directed at the liquid filaments is air, which provides a generally inexpensive and conveniently available quenching gas. Other gases are also suitable and are well known and can be selected by those of ordinary skill in the art without undue experimentation.

The temperature of the gas flow is regulated in order to achieve an optimum rate of filament cooling. It has been found that when polyester filaments of approximately 40 to 60 denier are being produced, a desirable temperature for the quenching gas flow is slightly below room temperature, preferably about 19° C.

Likewise, the flow rate of the gas flow is regulated to achieve an optimum level for cooling the filaments without damaging them. For example, when polyester filaments of approximately 150 to 180 spun denier are being produced, a desirable rate of flow for the gas is at about 250 feet per minute (or about 76 meters per minute.) It will be understood that other flow rates can also be used and can readily be determined by one having ordinary skill in the art without undue experimentation.

By utilizing the method of the present invention, industrial denier filaments can be formed at a much higher rates of production than previously achievable by prior art methods for forming such large denier polymer filaments. For example, conventional water quench systems for producing industrial-size polyester filaments produce filaments at approximately 47 meters per minute. In comparison, the same large size polyester filaments formed by the air quench system of the present invention have been produced at approximately 154 to 562 meters per minute.

Following spinning, quenching, and take-up, the hollow filaments can be drawn in conventional fashion to a final denier. In preferred embodiments for typical industrial applications, the filaments are drawn to the 40 to 60 denier range.

Further, it has been discovered that the hollow filaments formed by this method are substantially as stiff (resistance to bending) as their solid counterparts. The filaments have a larger diameter than filaments of the same denier formed by the water quench method due to the hollow core of the air quenched filaments. Larger diameter filaments are thus produced from less polymer material. For example, a 40 denier polyester filament made by the present invention has a diameter of approximately 0.126 mm and a 60 denier polyester filament made by the present invention has a diameter of approximately 0.155 mm, as compared to 40 and 60 denier solid filaments, which have diameters of 0.115 mm and 0.141 mm, respectively. Industrial filaments can therefore be produced which have the substantial stiffness and outside diameter of a 40 denier solid filament, for example, but are actually less than 40 denier and hence require less material to produce. Stated differently, for a given desired diameter filament the invention provides the desired diameter at a lower denier, and thus at a higher rate of productivity and lower cost.

In another aspect, the invention comprises a novel industrial-size thermoplastic polymer filament. The filament has a hollow core, the cross-sectional area of which constitutes between about 15 to 35% of the total cross-sectional area of the filament, preferably about 20%. The filament has a size of 30 denier or above, with those filaments in the 40 to 60 denier range being particularly useful in such industrial applications as the formation of scouring pads. The filament is formed from any polymer which can be provided in liquid form. In particularly preferred embodiments, the filaments are formed from a polyester such as polyethylene terephthalate (PET) or nylon.

As a further consideration, the degree of polymerization for polyester filaments should be high enough to produce an intrinsic viscosity of at least about 0.54 deciliters per gram (dl/g). The intrinsic viscosity (IV) is calculated from the relative viscosity (RV) of a solution of polyester in orthochlorophenol using a Schott AVS automatic viscosity instrument.

Using this system, the relationship between IV and RV is:

$$RV=1+C(IV)+0.305C^2(IV)^2+1.83\times10^{-3}C^4e^{4.5(IV)};$$

where C is a percentage defined by the weight of the polymer in grams multiplied by the density of orthochlorophenol and divided by the weight of orthochlorophenol in grams, and where "e" represents the base of natural logarithms.

The filaments of the present invention differ from water quenched filaments, particularly in the relative surface texture and degree of translucence of the resulting filaments. Conventionally, water quenched polyester filaments are clear. Delustrants are often added to such filaments in order to render them translucent rather than transparent. It has been discovered, however, that polyester filaments which are air quenched by the present method tend to be slightly more opaque than their water quenched counterparts.

In addition, the air quenched filaments tend to have a different surface texture than water quenched filaments. This is believed to be a function of the quenching medium, because gases such as air tend to be slower to transfer heat from polymer filaments than water. Although the inventors do not wish to be bound by any particular theory, it appears that the air quenched filaments tend to be more crystalline than those which have been water quenched, and the air quenched filaments avoid the tendency to form a solidified skin around a liquid polymer core, as often occurs in water quenching.

The present invention thus allows for the production of industrial denier filaments of thermoplastic polymer at high rates of production while avoiding the difficulties encountered by liquid quenching.

In the specification, there have been disclosed typical preferred embodiments of the invention and, although specific terms are employed, they are used in a generic and descriptive sense only and not for purposes of limitation, the scope of the invention being set forth in the following claims.

That which is claimed:

1. A process for producing industrial denier hollow filaments of a thermoplastic polymer at higher rates of production and while avoiding the use of liquid quenching media, the process comprising:

extruding the liquid polymer in the form of hollow filaments at a throughput and rate of take up that produces individual filaments of greater than about 130 spun denier; and directing a flow of a gas at the plurality of hollow liquid polymer filaments at a flow rate and temperature that are sufficient to quench and solidify the individual filaments in the absence of any other quenching fluid.

2. A process according to claim 1 wherein the step of directing the flow of gas comprises directing a flow of air.

3. A process according claim 1 wherein the step of directing the flow of gas comprises directing gas which has a temperature of approximately 19° C.

4. A process according to claim 1 wherein the step of directing the flow of gas comprises directing said flow of gas at a speed of approximately 250 feet per minute.

5. A process according to claim 1 wherein the step of extruding the liquid polymer comprises extruding polyester.

6. A process according to claim 1 wherein the step of extruding the liquid polymer comprises extruding nylon.

7. A process according to claim 1 wherein the rate of take up is between about 154 and 562 meters per minute.

8. A process according to claim 7, wherein the step of extruding is performed at a throughput and rate of take-up that produces individual hollow filaments of at least about 130 denier.

9. A process according to claim 8 wherein the step of extruding the liquid polymer comprises extruding hollow filaments in which the hollow cross-sectional area constitutes approximately 20% of the total cross-sectional area of the filament.

10. A process according to claim 8 further comprising drawing the filaments to a finished denier of between about 40 and 60 denier.

11. A process according to claim 10 comprising drawing the filaments to a diameter of approximately 0.126 and 0.155 millimeters.

* * * * *